United States Patent [19]

Goff, Jr. et al.

[11] 3,965,944

[45] June 29, 1976

[54] LIGHTWEIGHT NARROW ELASTIC FABRIC

[75] Inventors: Richard E. Goff, Jr., Barrington; Normand D. Guay, Woonsocket, both of R.I.

[73] Assignee: Johnson & Johnson, New Brunswick, N.J.

[22] Filed: Feb. 12, 1975

[21] Appl. No.: 549,605

[52] U.S. Cl. ..... 139/421; 139/419

[51] Int. Cl.[2] ..... D03D 15/08; D03D 19/00

[58] Field of Search ..... 139/421–423, 139/419; 161/77; 428/230, 231

[56] References Cited

UNITED STATES PATENTS

| | | | |
|---|---|---|---|
| 1,666,325 | 4/1928 | Chisholm | 139/421 |
| 1,961,961 | 6/1934 | Coldwell | 139/421 |
| 3,221,736 | 12/1965 | Heitzmann | 139/421 X |
| 3,788,366 | 1/1974 | Campbell, Sr. et al. | 139/421 |
| 3,858,622 | 1/1975 | Campbell et al. | 139/421 |

FOREIGN PATENTS OR APPLICATIONS

| | | | |
|---|---|---|---|
| 282,074 | 5/1966 | Australia | 139/421 |
| 192,864 | 11/1957 | Austria | 139/421 |
| 18,931 | 1901 | United Kingdom | 139/421 |
| 1,118,292 | 6/1967 | United Kingdom | 139/421 |

*Primary Examiner*—James Kee Chi

[57] ABSTRACT

A lightweight, narrow, elastic fabric of nonelastic monofilament warp yarns leno woven in the form of a sine-wave with elastic warp yarns in the stretched condition, with a plurality of synthetic texturized warp yarns disposed between each pair of leno woven yarns. In the relaxed state the monofilament yarns are in a contracted sine-wave shape with the gap between opposing crests of adjacent monofilament yarns decreased to contain the texturized yarns therebetween.

11 Claims, 5 Drawing Figures

LIGHTWEIGHT NARROW ELASTIC FABRIC

This invention is concerned with a narrow elastic fabric suitable for use in the waist encircling portions of articles of apparel, the leg encircling portions of stockings, straps for brassieres and other lingerie articles, and for general use in articles of wearing apparel especially when the apparel is in direct contact with the skin.

BACKGROUND OF THE INVENTION

The fabrication of elastic fabrics suitable for use in wearing apparel has generally focused on combining essential qualities of such a product with desirable qualities which will make the product more functional in its intended use. Such essential characteristics as necessary stretch and shrinkage properties, good resiliency and washability of elastic fabrics have been combined with desirable aesthetic and lightweight qualities in various articles of apparel. However, in order to maintain fabric strength and rigidity in lightweight elastic fabrics, threads with greater stiffness had to be incorporated in the fabric. These threads, generally the monofilaments, are inherently coarse, and if the fabric with these threads is intended to come in contact with the skin, these coarse threads must be adequately covered by other threads, thereby compromising aesthetic and lightweight features.

SUMMARY OF THE INVENTION

We have discovered an improved narrow elastic fabric which overcomes the problems of combining the features of softness, pleasing aesthetics and lightweight design with fabric strength, stability and minimum yarn slippage. Our new elastic fabric is suitable for use in the encircling portions of garments such as trousers, underwear and stockings, in straps used in brassieres and general lingerie purposes, and especially in garments that come in direct contact with human skin. Our new elastic fabric has the essential features of good stretch, low shrinkage, resiliency, strength and washability and the desirable properties of pleasing aesthetics, and a smooth, soft, fluffy, nonirritating and pleasing feel.

In accordance with the present invention, our new improved elastic fabric comprises a set of warp yarns and a set of filling yarns. The warp set contains elastic yarns, nonelastic monofilament yarns and synthetic texturized yarns. The elastic yarns are leno woven with the nonelastic monofilament yarns so that each monofilament yarn assumes the shape of a substantially regular or uniform sine-wave. The leno woven yarns are arranged in the woven fabric such that the crests of adjacent sine-wave monofilament yarns are facing each other in diametrically opposed alignment. Disposed between each pair of the leno woven yarns is a plurality of synthetic texturized yarns.

Our new improved fabric is woven with the elastic yarns under tension. When the fabric is allowed to relax, the monofilament yarns contract in the warp direction and the gaps between opposing adjacent crests of the monofilament yarns are reduced or decreased in a pinching action. The synthetic texturized yarns positioned between the leno woven yarns are pinched or squeezed in the areas between opposing crests. However, in the areas formed by the valleys of the contracted adjacent sine-wave monofilaments, the synthetic texturized yarns spread out into a soft, fluffy condition.

The fabric of the present invention also contains a set of filling yarns. Preferably, there are three filling yarns woven between each crossing of the leno woven yarns, though other numbers of filling yarns may be used. When three filling yarns are used between each crossing of the leno woven warp yarns, the filling yarns are woven in a plain weave with the leno woven warp yarns. The filling yarns are woven with the synthetic texturized warp yarns alternately in a plain weave and a floating weave. In those areas of the fabric where the leno woven nonelastic monofilament warp yarns are adjacent each other, the synthetic texturized warp yarns and the filling yarns are woven in elastic plain weave and in those areas where the elastic leno woven warp yarns are adjacent each other the synthetic texturized warp yarns are alternately floated over or under three filling yarns.

In one embodiment of the elastic fabric of the present invention, texturized yarns may be woven along the edge portions of the elastic fabric. This is especially desirable when monofilament filling yarns are used in order to cover the rough bent edges of these yarns. The edge portions may comprise one or more elastic yarns and a plurality of texturized yarns. Any weave, such as a three-by-one weave, that will produce a rounded edge completely covered by texturized yarns, may be used in constructing the edge portions.

DESCRIPTION OF THE DRAWINGS

The invention will be described in greater detail in conjunction with the accompanying drawings in which.

DETAILED DESCRIPTION OF THE DRAWINGS

Figure 1:
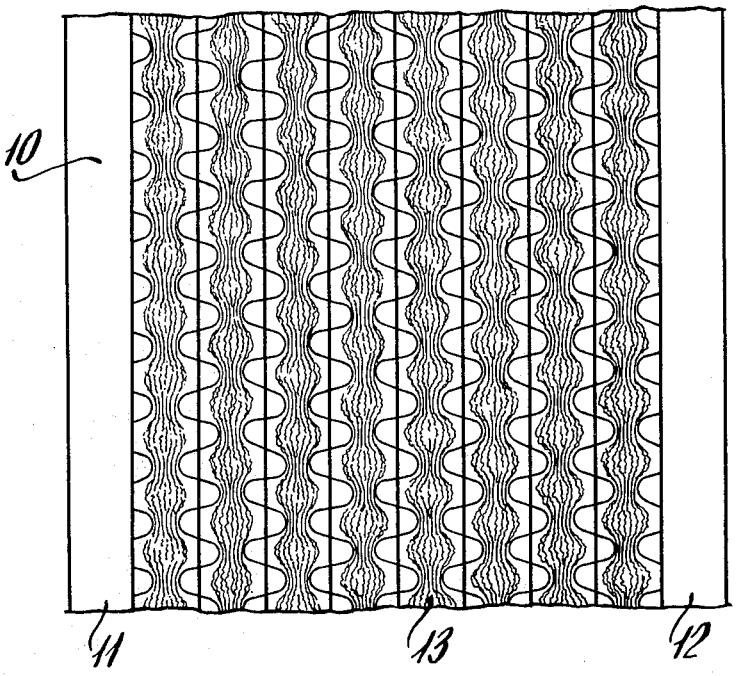
FIG. 1 is a plan view of a portion of a narrow elastic fabric of the present invention.

In FIG. 1 a narrow elastic fabric 10 of the present invention is shown. The fabric comprises two outer or edge portions 11 and 12 and a center portion 13. The center and edge portions preferably have different constructions depending on the desired properties of the outer edges. The center portion of the fabric is where the new improved structure lies.

Figure 2:
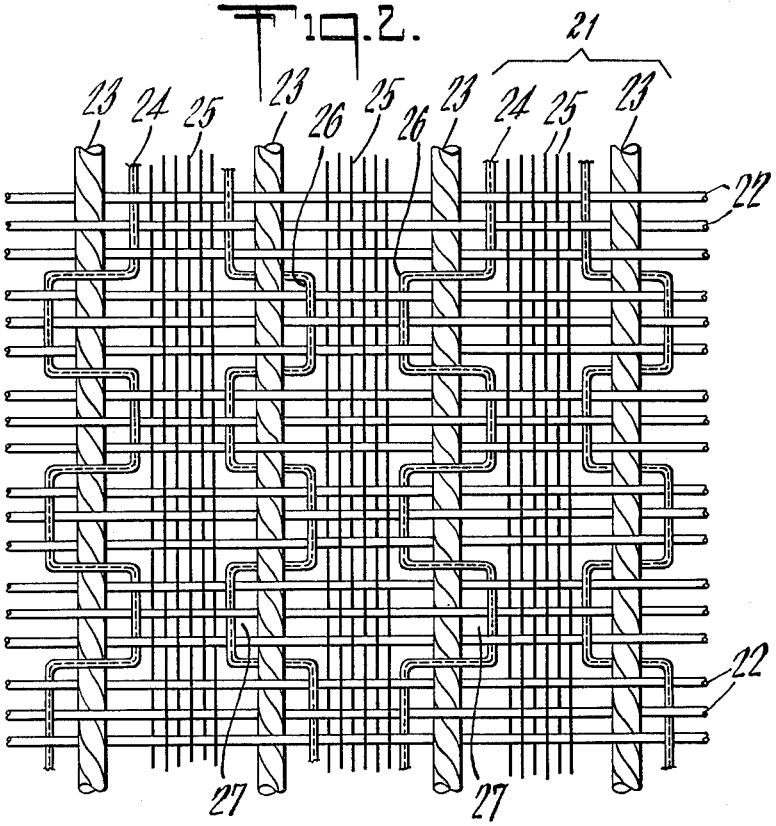
FIG. 2 is an enlarged plan view showing a portion of the leno weave of the fabric in the stretched state.

Referring more specifically to FIG. 2, the center portion 13 is comprised of a set warp yarns 21 and a set of filling yarns 22. The set of warp yarns running in the longitudinal direction contains three different types of yarns. The first type is elastic yarns 23, which may either be rubber core or spandex core yarns. These yarns may be covered or wrapped with other yarns such as nylon, polyester, rayon, etc., as may be desirable to produce a fabric with pleasing, attractive qualities.

Also contained within the warp set are nonelastic monofilament warp yarns 24. These monofilament yarns are selected for their qualities of stiffness and rigidity and may be made from nylon, polypropylene or any of the well-known monofilament yarns suitable for fabrics.

The third type of yarns in the warp set are synthetic texturized yarns 25, such as nylon, polyester, etc. These yarns provide soft, smooth properties to the elastic fabric which in turn is rendered nonirritating and has a pleasing touch to human skin.

As shown in FIG. 2 the elastic warp yarns 23 are leno woven with the nonelastic monofilamnt warp 24 yarns, the monofilament yarns being the oscillating yarns in the leno weave. The monofilament yarns 24 may be woven so that they all cross over or on top of the elastic yarns 23 (as viewed in FIG. 2), or all cross under or below the elastic yarns, or some over and some under, depending upon the desirable qualities expected from the elastic fabric.

The fabric of the present invention is woven with the elastic warp yarns 23 in the stretched condition, as shown in FIG. 2. When the monofilament yarns are leno woven with the stretched elastic yarns, the monofilament yarns 24 form a substantially regular or uniform sine-wave shape; i.e., a smoothly, waving form characterized by crests 26 and valleys 27. The crests are of substantially equal height and alternate on each side of the elastic yarns. Each crest 26 is substantially equidistant from the next crest when travelling in the longitudinal direction of the fabric. The leno woven yarns are arranged in the fabric so that the crests, or high-points, of adjacent sine-wave monofilament yarns are facing each other in diametrically opposed alignment; i.e., the sine-waves of adjacent monofilaments are out of phase with each other such that the crests directly face each other.

When the fabric is in the stretched condition, the facing crests do not touch each other. Disposed in the gaps created by each pair of facing crests are a number of synthetic texturized yarns 25. The texturized yarns are also woven into the fabric when the elastic yarns are in the stretched state. The gap between opposing crests, when the fabric is stretched, is sufficient for a plurality of texturized yarns to lie in the warp direction without any transverse forces of opposing crests acting on them. These yarns are woven in a substantially straight path.

The warp yarns are woven with the filling yarns 22. To provide desirable stiffness and transverse strength, it is preferable that the filling yarns be monofilament and made from such materials as nylon, polypropylene and the like. The filling yarns 22 are woven with the leno woven yarns so that there are preferably three filling yarns between each crossing of the leno yarns. The filling yarns are preferably woven with the leno woven warp yarns in a plain one-by-one weave as shown in FIG. 2. The filling yarns are woven with the synthetic texturized warp yarns 25 in the area between the crests 26 in a plain weave and in the area between the valleys 27 in a floating weave wherein alternate synthetic texturized warp yarns pass over or under three adjacent filling yarns as is shown in FIG. 2.

Figure 3:
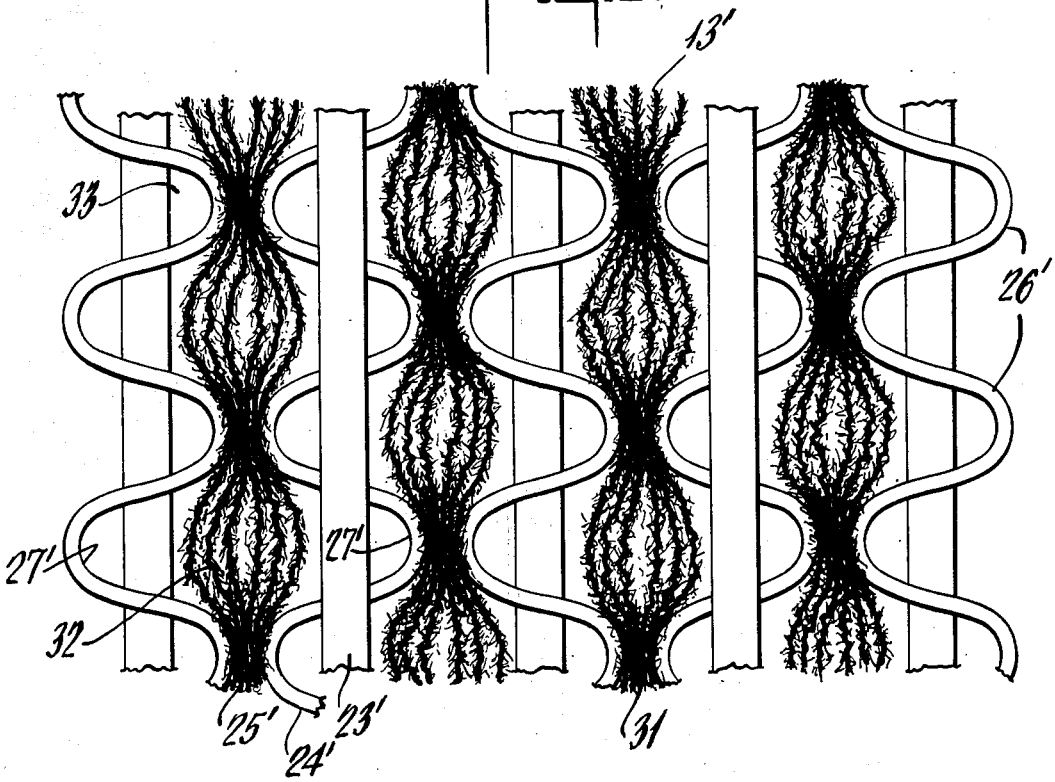
FIG. 3 is an enlarged plan view showing a portion of the fabric in its relaxed condition.

When the elastic fabric of the present invention is in the relaxed or unstretched condition, the configuration of the warp yarns is substantially different from that in the stretched condition. In FIG. 3, the center portion 13' of the elastic fabric is shown in the relaxed state, with the elastic yarns 23' unstretched. It can be seen that the sine-wave monofilament nonelastic yarns 24' assume a contracted shape upon the relaxation of the elastic yarns. The relaxation of tension on the elastic yarns draws the crests 26' of each monofilament closer together along the longitudinal or warp direction so that the distance between successive crests is reduced. Concurrent with the preceding, the amplitude or height of the crests 26' increases thereby making the gap 31 between adjacent opposing crests smaller.

Since the synthetic texturized yarns are woven between leno woven yarns in the gaps provided by adjacent opposing crests, it can readily be seen that upon fabric relaxation, when the crests 26' of the sine-wave yarns increase in amplitude and adjacent opposing crests draw closer to each other reducing the gaps therebetween, the texturized yarns 25' are pinched or squeezed between the closely opposing crests. This squeezing force acts in compressive fashion and acts within the plane of the fabric.

When the fabric is relaxed the portions of the synthetic texturized yarns 32 between opposing valleys 27' of the monofilament yarns spread out towards the elastic yarns 23' lying in each valley 27'. The spreading out effect is a result of the nature of the texturized yarns, the floating weave of these yarns as previously described and the squeezing action by the monofilaments. When they are woven in the stretched condition of the fabric the texturized yarns are smooth and straight. Upon fabric relaxation, the texturized yarns spread out and bulk, and this fluffy condition is accentuated or magnified in the valleys or those areas 32 not between pinching monofilament crests.

When the texturized yarns spread out into a fluffy state, they also cover a portion of the monofilament yarns. Thus, in the relaxed state the monofilament warp yarns 24' are barely visible, the attractive pattern viewed a combination of the elastic and texturized yarns. The pattern also contains openings 33 between the elastic yarns and the peaks of each crest formed by the monofilament warp yarns. The fluffy portions of the texturized yarns do not invade these areas when the fabric is relaxed because of the pinching or squeezing action of the monofilament yarns combined with the 1/1 plain weave of the synthetic texturized yarns. These openings provide good ventilation to the fabric besides contributing to its pleasing visual effect.

Figure 4:
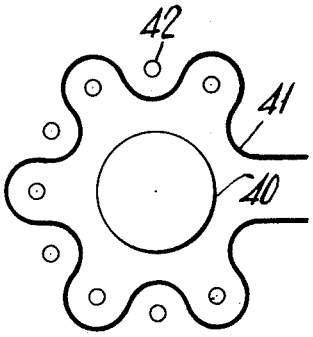
FIG. 4 is a cross-sectional view of the edge portion of one embodiment of the elastic fabric.

In the weave of the longitudinal edge portions 11 and 12 of one embodiment of the fabric of the present invention, it is preferred that at least one elastic yarn of the same type as used in the center portion be included, along with a plurality of texturized yarns. The texturized yarns and the elastic yarns lie in the warp direction of the fabric with the texturized yarns arranged around the periphery of the outermost elastic yarns. The texturized yarns and the elastic yarns are woven with the filling yarns, so that the filling yarn bends are covered by the texturized yarns. As seen in FIG. 4, the cross-sectional view shows a center elastic yarn 40. The elastic yarn 40 is surrounded by the filling yarn 41 and the texturized yarns 42 woven in alternating fashion. The filling yarn may be woven, however, with the elastic and texturized yarns in any suitable weave to hold the filling yarns in place, such as a three-by-one weave. The edge portions comprised of the above yarns and structure are soft and smooth and are very compatible with the smoothness features of the center portion of the fabric.

Figure 5:
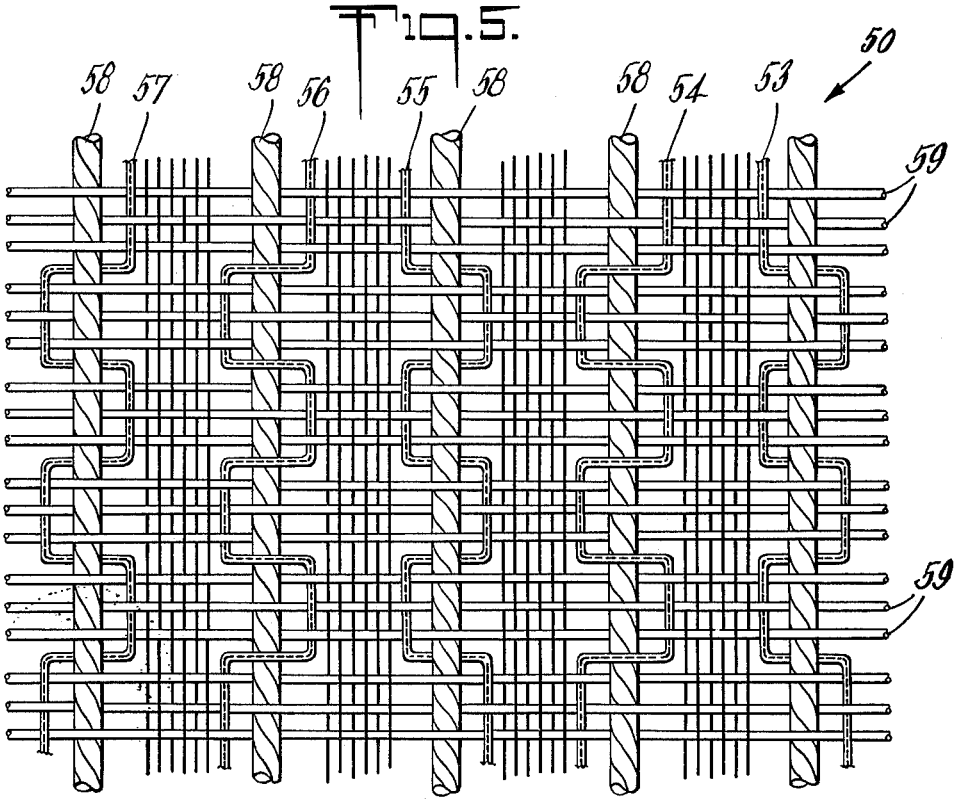
FIG. 5 is an enlarged plan view of another embodiment of the elastic fabric shown in the stretched condition.

One embodiment of the present invention is shown in FIG. 5. It has been noted that a fabric that is completely stable and balanced is often desirable. The structure of an elastic fabric 50 as depicted in FIG. 5 will provide such stability and balance.

To accomplish these desirable features, starting from one side of the fabric (in this instance the right side as viewed in FIG. 5), each alternate leno woven monofilament yarn is woven on top of or below the elastic yarns. Thus, monofilament yarn 53 is shown woven below or under elastic yarn 58; the next monofilament yarn 54 crosses on top of the elastic yarn. This pattern continues across the fabric until the last or outermost leno woven yarn is reached. The outermost monofilament 57 in this embodiment is woven on the same face or surface of the fabric as the first monofilament yarn 53 and is woven in a reverse leno weave with respect to the first monofilament yarn, reverse in the sense that the crests of the outermost monofilament yarns face in alignment toward each other. The filling yarns 59 are woven in a plain weave with the leno woven warp yarns, with three filling yarns between each crossing of the leno woven yarns. The filling yarns are woven with the synthetic texturized warp yarns in a plain one-by-one weave in the areas between adjacent monofilament warp yarns. The filling yarns are woven with the synthetic texturized warp yarns in a three-by-one floating weave in those areas where the leno woven elastic yarns are adjacent each other. The fabric constructed according to this embodiment will not only be soft, smooth and fluffy, but will lie flat with minimum roll-over of the outer edges throughout its use.

The fabric of the present invention contains from 7 to 18 elastic warp yarns per inch in the center portion of the fabric. For each elastic warp yarn in the center portion there is a non-elastic monofilament warp yarn leno woven with the elastic yarn. The number of synthetic texturized yarns disposed between each pair of leno woven yarns may vary from about 2 to 20. The final appearance or pattern of the fabric, its strength, openness and use generally determine the size and number of warp yarns used in the fabric.

The nonelastic monofilament warp yarns preferably have a denier from about 150 to 1100. It is desirable to maintain the monofilament denier above 150 in order for sufficient resiliency to be imparted to the fabric into which they are woven. However, monofilament deniers above 1100 tend to offer too much resistance to stretch characteristics of the new fabric. It has been found that monofilament deniers of about 330 provide optimum resiliency and strength properties compatible with the elastic fabric into which they are incorporated.

Strength and resiliency characteristics of the new fabric are also controlled by the size of the filling yarns. The preferred filling yarns are monofilaments with a denier ranging from 200 to 1200. If the fabric width is about one inch, a denier of about 420 is suitable.

The following example is illustrative of a new elastic fabric according to the present invention.

EXAMPLE

A narrow elastic fabric is woven in accordance with the principles of the present invention. The fabric has a width of approximately 1¼ inches, containing a center portion and two outer edge portions. The center portion has 9 elastic yarns with each yarn having a spandex core of approximately 1680 denier which has been initially wrapped with 2 ends of 40 denier multifilament nylon yarn and top covered with one end of 40 denier polyester yarn. Leno woven with each elastic yarn is a nonelastic monofilament yarn of nylon having a denier of approximately 330. Disposed between each pair of leno woven yarns are 6 texturized nylon yarns. The filling yarns are 420 denier monofilament nylon yarns. The warp yarns and the filling yarns are woven as described and depicted in conjunction with FIG. 5, thereby forming the center portion of the fabric. Along each outer edge of the fabric are woven elastic yarns similar to those used in the center portion of the fabric and a plurality of texturized nylon yarns. The elastic and texturized nylon yarns of each edge portion are woven with the filling yarns in a tubular three-by-one weave so that the texturized nylon yarns are arranged in rounded fashion about the periphery of the elastic yarns. The fabric thus produced is soft, open and lightweight, has good stiffness and strength and the widthwise direction and makes an excellent support band for articles of wearing apparel.

The above description should not be construed as limited thereby nor to the specific features mentioned therein but to include various other equivalent features as set forth in the claims appended hereto. It is understood that any suitable changes, modifications and variations may be made without departing from the spirit and scope of the invention.

What is claimed is:

1. A narrow elastic fabric comprising a set of warp yarns and a set of filling yarns, said set of warp yarns containing elastic yarns, nonelastic monofilament yarns and synthetic texturized yarns, each of said elastic yarns woven with a monofilament yarn so that each monofilament yarn is a leno woven warp yarn forming a substantially uniform sine-wave shape, the crest of adjacent sine-wave monofilament yarns disposed in diametrically opposed alignment, a plurality of said texturized yarns disposed between each pair of leno woven yarns, the filling yarns woven with the synthetic texturized yarns in a one-by-one plain weave between adjacent leno woven monofilament warp yarns and said synthetic texturized yarns floating over or under at least three adjacent filling yarns between adjacent leno woven elastic warp yarns, said fabric woven under tension so that when the fabric is relaxed said monofilament sine-wave yarns contract in the warp direction with said opposing adjacent crests being drawn closer to each other, said texturized yarns being squeezed in the plane of the fabric between said closely opposing adjacent crests and being spread out into a soft, fluffy condition in those areas not between opposing crests.

2. A narrow elastic fabric according to claim 1 wherein the elastic yarns are spandex core yarns wrapped with nylon yarns.

3. A narrow elastic fabric according to claim 1 wherein the monofilament warp yarns are nylon yarns.

4. A narrow elastic fabric according to claim 3 wherein the filling yarns are monofilament nylon yarns.

5. A narrow elastic fabric having a center portion and two longitudinal edge portions, the center portion comprising a set of warp yarns and a set of filling yarns, said set of warp yarns containing elastic yarns selected from the group consisting of rubber core yarns and spandex core yarns, nonelastic monofilament yarns, and synthetic texturized yarns, each of said elastic yarns woven with a monofilament yarn so that each monofilament yarn is a leno woven warp yarn forming a substantially uniform sine-wave shape, the crests of adjacent sine-wave monofilament yarns disposed in diametrically opposed alignment, a plurality of said texturized yarns disposed between each pair of leno woven yarns, the filling yarns woven with the synthetic texturized yarns in a one-by-one plain weave between adjacent leno woven monofilament warp yarns and said synthetic texturized yarns floating over or under at least three adjacent filling yarns between adjacent leno woven elastic warp yarns, each edge portion of said fabric containing at least one elastic warp yarn and a plurality of texturized warp yarns, said filling yarns woven with the warp yarns in both outer longitudinal edge portions of the fabric, said fabric woven under tension so that when said fabric is relaxed said monofilament sine-wave yarns contract in the warp direction with said opposing adjacent crests being drawn closer to each other, said texturized yarns of the center portion being squeezed in the plane of the fabric between said closely opposing adjacent crests but being spread out into a soft, fluffy condition in those areas not between opposing crests.

6. A narrow elastic fabric according to claim 5 wherein adjacent elastic yarns are disposed on opposite faces of the fabric and the outermost leno woven monofilament yarns are disposed on the same face of the fabric and woven in a reverse leno weave with respect to each other.

7. A narrow elastic fabric according to claim 5 wherein the filling yarns are monofilament nylon yarns.

8. A narrow elastic fabric according to claim 5 wherein from 7 to 18 elastic warp yarns per inch are used in the warp set in the center portion of the fabric.

9. A narrow elastic fabric according to claim 5 wherein the nonelastic monofilament yarns have a denier of from 150 to 1100.

10. A narrow elastic fabric according to claim 5 wherein the synthetic texturized yarns are nylon yarns.

11. A narrow elastic fabric according to claim 5 wherein the elastic yarns are spandex core yarns wrapped with nylon multifilament yarns, the nonelastic monofilament yarns have a denier of 330, the filling yarns are monofilament nylon yarns and the warp set in the center portion of the fabric contains from 7 to 18 elastic warp yarns per inch.

* * * * *